US008025375B2

(12) United States Patent
Lu et al.

(10) Patent No.: US 8,025,375 B2
(45) Date of Patent: Sep. 27, 2011

(54) UNINTERRUPTED INK SUPPLY SYSTEM

(75) Inventors: Yi-Ching Lu, Hsinchu (TW); Ming-Chung Peng, Hsinchu (TW); Jian-Wei Huang, Yilan Hsien (TW)

(73) Assignee: JETBEST Corporation, Hsinchu (TW)

( * ) Notice: Subject to any disclaimer, the term of this patent is extended or adjusted under 35 U.S.C. 154(b) by 256 days.

(21) Appl. No.: 12/430,285

(22) Filed: Apr. 27, 2009

(65) Prior Publication Data

US 2010/0201761 A1 Aug. 12, 2010

(30) Foreign Application Priority Data

Feb. 11, 2009 (TW) ..... 98104317 A

(51) Int. Cl.
*B41J 2/175* (2006.01)

(52) U.S. Cl. ..... 347/85

(58) Field of Classification Search ..... 347/85
See application file for complete search history.

(56) References Cited

U.S. PATENT DOCUMENTS 5,595,223 A * 1/1997 Hayao ..... 347/85

* cited by examiner

*Primary Examiner* — Stephen Meier
*Assistant Examiner* — Tracey McMillion
(74) *Attorney, Agent, or Firm* — Rabin & Berdo, P.C.

(57) ABSTRACT

An uninterrupted ink supply system is provided, including a main cartridge connected to a printer, a connection device having an automatic airflow control structure and installed on said main cartridge, and a replenishment cartridge for connecting to the connection device. The replenishment cartridge is connected to the connection device, and is able to refill the ink into the main cartridge, and automatically stop refilling when the ink level reaching a specific height and start refilling again when ink level below a specific height. When the replenishment cartridge is removed for refilling when the ink is used up, the main cartridge still contains ink so that the printing will not be suspended.

9 Claims, 7 Drawing Sheets

UNINTERRUPTED INK SUPPLY SYSTEM

FIELD OF THE INVENTION

The present invention generally relates to an ink supply system of inkjet printer or related electronic inkjet printing device.

BACKGROUND OF THE INVENTION

The inkjet printing technology has been used in many years. As the printers become popular, the amount of cartridge usage also increases. The environmental impact and the related recycling issues of disposable cartridge also becomes a problem.

In general, a cartridge is disposable when the cartridge stops supplying ink to the printer. Usually, at this point, there remains a small amount of ink inside the cartridge, which is both a waste and a pollution. A refillable cartridge is developed to decrease the waste and the pollution caused by a conventional disposable cartridge. A refillable cartridge can be refilled with ink using a funnel. However, the design is prone to causing spill or overflow of ink during the refilling. In addition, the user must watch for the ink level to prevent from using up the ink. During the refilling, the printing must be stopped. An alternative is to use a pump to replace the manual refilling. Unfortunately, the cost of the plural pumps and supporting frame, the time-consuming assembly and disassembly of frame, bulky size and high power-consumption are some of the disadvantages of the pump refilling approach.

SUMMARY OF THE INVENTION

The primary object of the present invention is to overcome the resource waste and the environmental pollution problems caused by conventional disposable cartridge.

Another object of the present invention is to overcome the problems of manual refillable cartridge, including possible spill, inconvenient printing suspension, and so on.

Yet another object is to overcome the problems of the pump refillable cartridge, including the cost of the plural pumps and supporting frame, the time-consuming assembly and disassembly of frame, bulky size and high power-consumption.

To achieve the above objects, the present invention provides an uninterrupted ink supply system, including a main cartridge, a connection device and a replenishment cartridge. The replenishment cartridge is connected to the connection device, which in turn is connected to the main cartridge to supply the ink to the printer. When the replenishment cartridge is removed for refilling when the ink is used up, the main cartridge still contains ink so that the printing will not be suspended. Therefore, the problems of waste, spill and power consumption of the conventional disposable and refillable cartridge are avoided.

The embodiment of the main cartridge of the present invention is similar to the conventional cartridge, for storing the ink and being able to be installed on a printer to provide the ink.

The embodiment of the replenishment cartridge of the present invention is a container for storing ink and includes a structure for connecting to the connection device.

The embodiment of the connection device of the present invention is for fixing to the inlet of the main cartridge so that the inside and the outside of the main cartridge can communicate through the connection device. The connection device includes a structure able to automatically control airflow without the electrical power. The main cartridge is connected to the replenishment cartridge through the connection device so that the ink inside the replenishment cartridge can flow into the cavity of the main cartridge through the connection device. The automatic airflow control structure of the connection device can automatically stop flowing the ink from the replenishment cartridge into the main cartridge when the ink level in the main cartridge is above a specific threshold, and automatically start flowing the ink from the replenishment cartridge into the main cartridge again when the ink level in the main cartridge is below a specific threshold. When the ink in the replenishment cartridge is used up, the replenishment cartridge can be removed for refilling. The ink inside the main cartridge can continue to supply the printing job so that the printing will not be interrupted for the refilling.

In comparison with the conventional manual refillable or pump refillable cartridge, the uninterrupted ink supply system of the present invention is smaller in size and more convenient to operate, as well as capable of uninterrupted ink supply without suspending printing job during refilling.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

Figure 1:
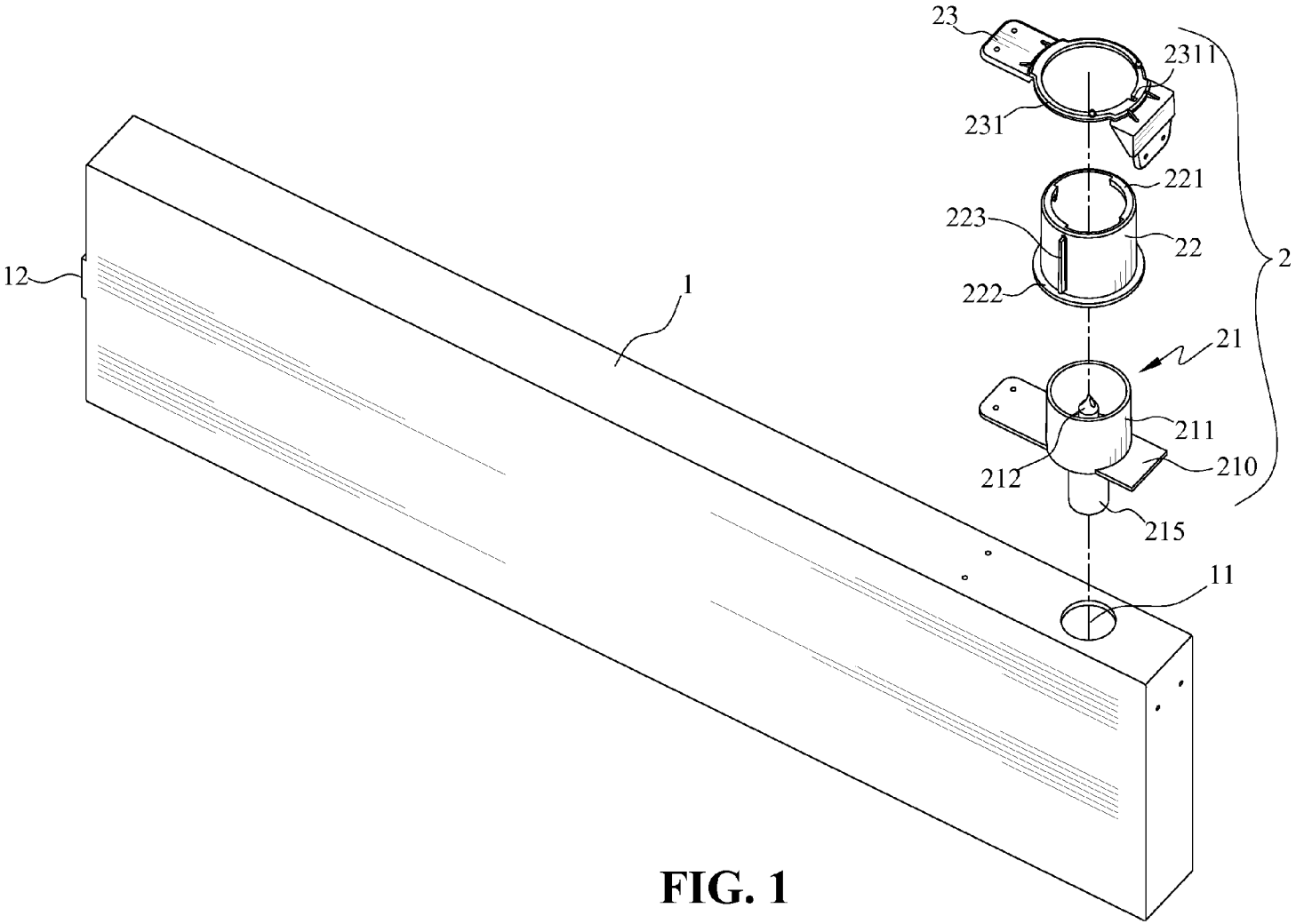
FIG. 1 shows a schematic exploded view of the components of the connection device and the assembly relation with the cartridges according to the present invention.
Figure 2:
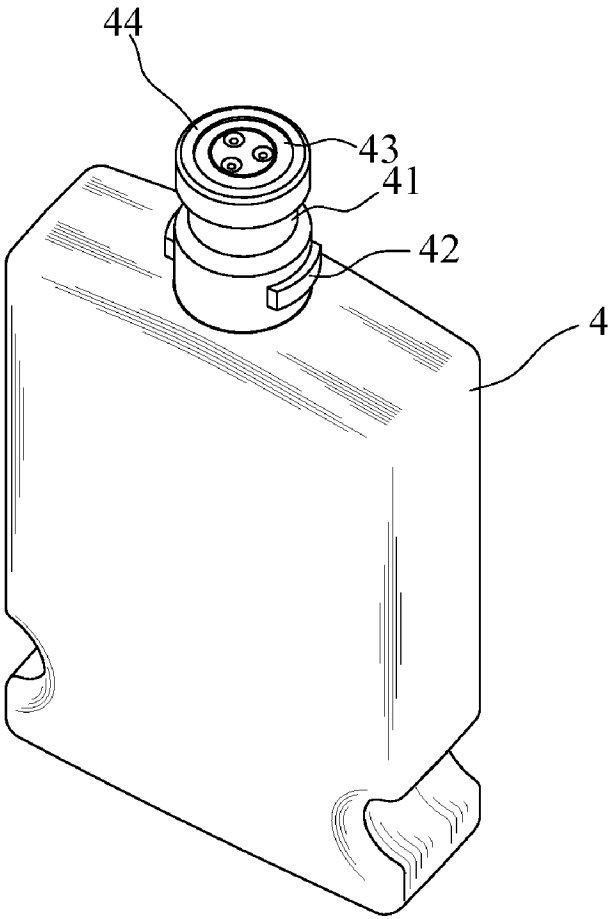
FIG. 2 shows a schematic view of the components of the replenishment cartridge according to the present invention.

FIG. 1 and FIG. 2 show an uninterrupted ink supply system of the present invention. As shown in FIG. 1 and FIG. 2, an uninterrupted ink supply system of the present invention includes a main cartridge 1 and a connection device 2 of FIG. 1, and a replenishment cartridge 4 of FIG. 2. Connection device 2 is installed on main cartridge 1 as a connection interface between main cartridge 1 and replenishment cartridge 4. The assembled main cartridge 1, connection device 2 and replenishment cartridge are shown in FIG. 3A.

Figure 3A:
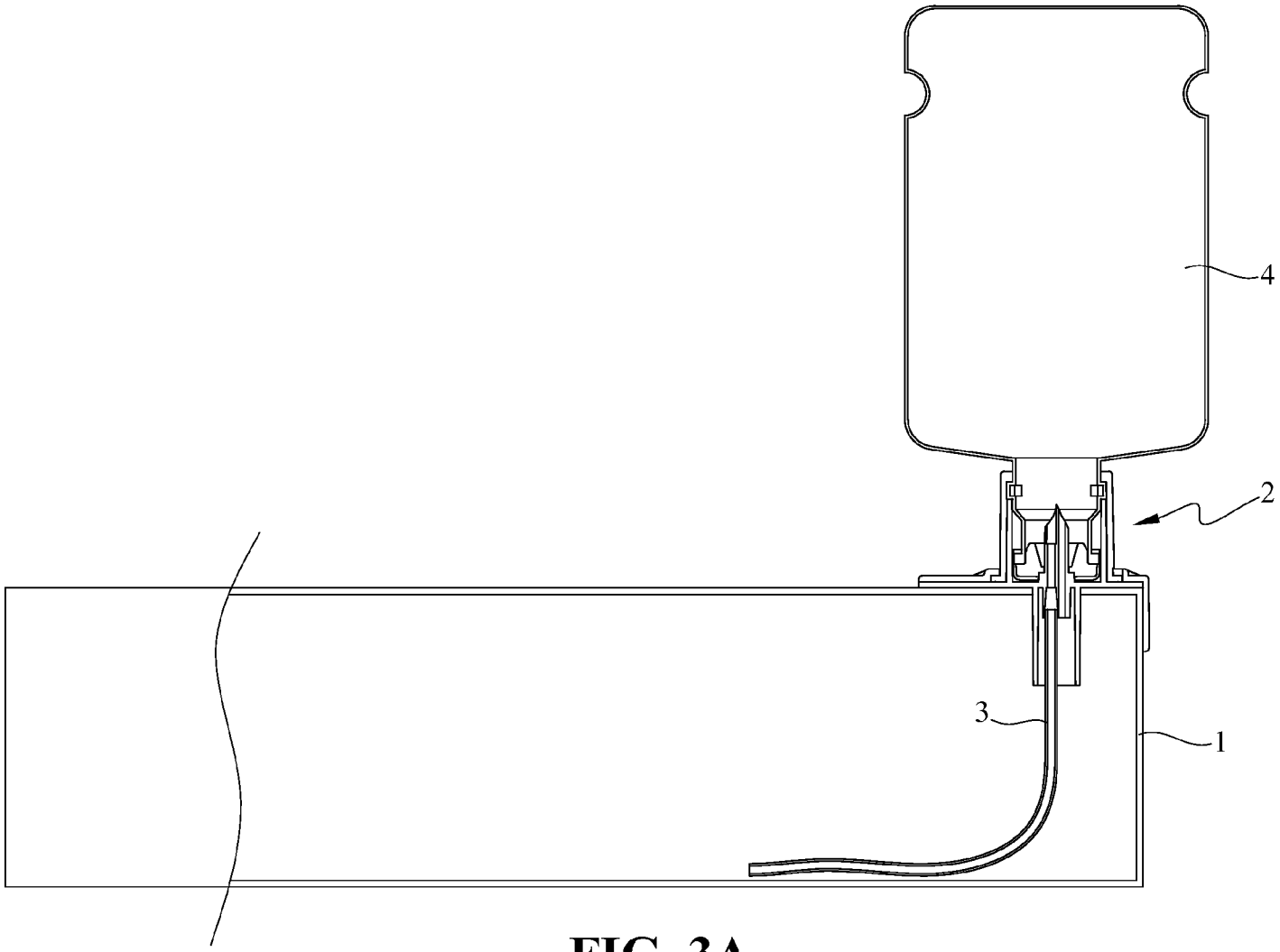
FIG. 3A shows across-section view of the replenishment cartridge assembled to main cartridge according to the present invention.
Figure 3B:
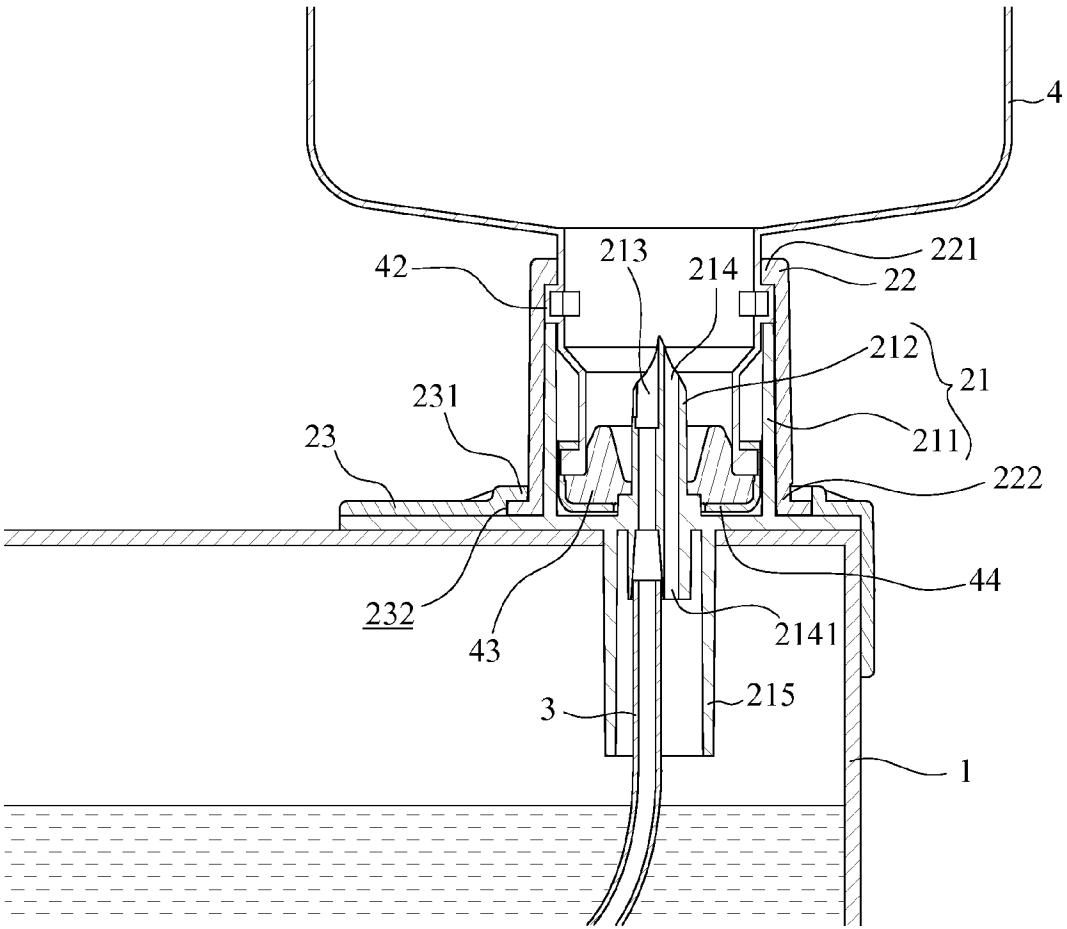
FIG. 3B shows a partial enlarged view of FIG. 3A, with ink level inside cavity of main cartridge lower than lower end of liquid air interface tube according to the present invention.

Refer to FIG. 1 and FIG. 3B. The preferred embodiment of main cartridge 1 of the present invention is a container made of suitable material with a cavity, and having an ink inlet 11 for injecting ink into. Also, an ink outlet 12 is included on the side or other suitable location on main cartridge 1 to provide the installation of main cartridge 1 in a printer or other printing device. An output interface (not shown) is included in ink outlet 12 so that the ink stored inside the cavity can be delivered to the inkjet system.

FIG. 1 and FIG. 3B show a preferred embodiment of connection device 2 of the present invention, including a connection base 21, a tube base 22 and a fix base 23. Connection base 21 includes a tube body 211 at the top and a liquid air interface tube 215 at the bottom, separated by a base plate 210. Connection base 21 also includes a central column 212 extending along the axis inside tube body 211 and liquid air interface tube 215. The lower end of liquid air interface tube 215 is lower than the lower end of central column 212. The internal of central column 212 includes an independent ink channel 213 and an independent air channel 214. Both ink channel 213 and air channel 214 flow through central column 212. In a preferred embodiment, the upper end of central column 212 forms a needle tip so as to penetrate replenishment cartridge 4. The lower end of central column 212 connection base 21 enters the cavity of main cartridge 1 through ink inlet 11, base plate 210 contacts the surface of main cartridge 1, and fastening elements are used to fasten base plate 210 to main cartridge 1. After assembly, liquid air interface tube 215 and central column 212 extending inside liquid air interface tube 215 are both inside the cavity of main cartridge 1, as shown in FIG. 3B.

Figure 4A:
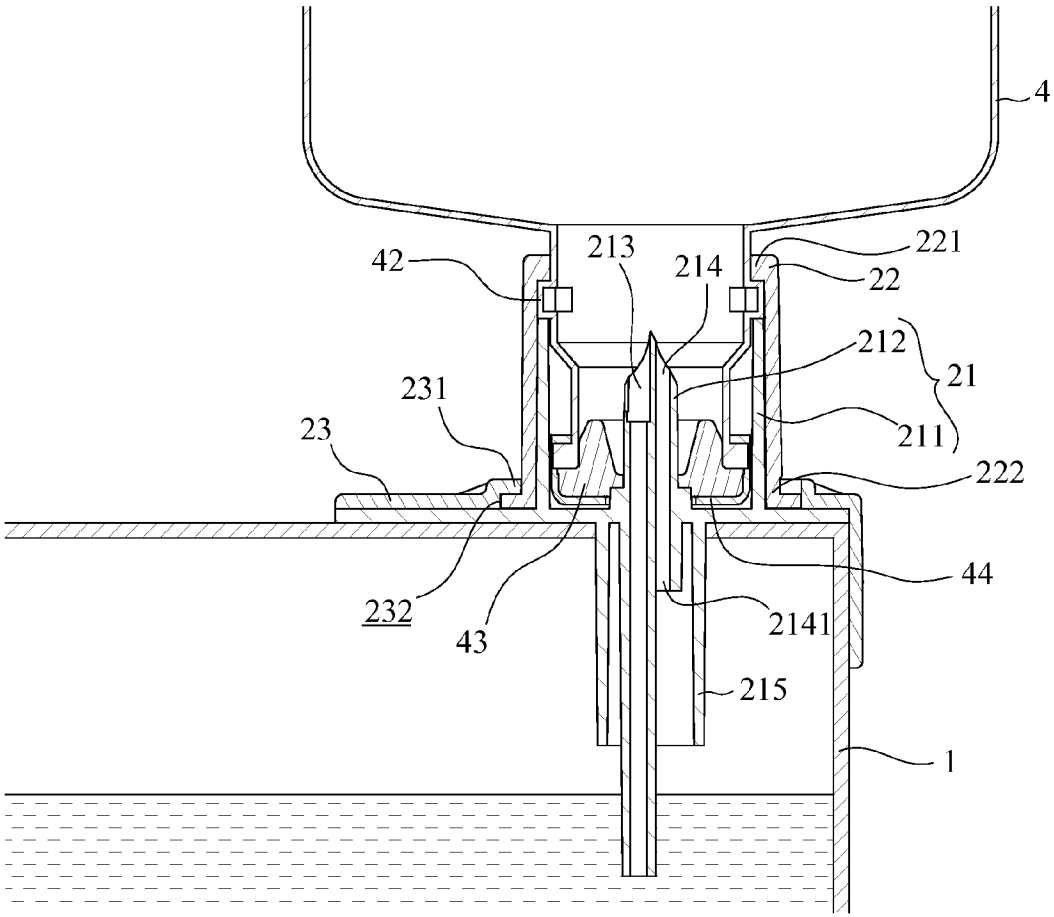
FIG. 4A shows a schematic view of the lower end of ink channel lower than the lower end of liquid air interface tube of the connection device, and ink level inside cavity of main cartridge lower than lower end of liquid air interface tube according to the present invention.

In the embodiment shown in FIG. 3A and FIG. 3B, the outlets of the lower ends of both ink channel 213 and air channel 214 of central column 212 are located at the same place. Hence, an extending tube 3 of no specific length can be attached to the outlet of the lower end of ink channel so that the lower end of extending tube 3 is lower than outlet 2141 of the lower end of air channel 214, and the outlet of the lower end of extending tube 3 is lower than the lower end of liquid air interface tube 215. FIG. 4A shows another embodiment where the lower end outlet of ink channel 213 is lower than the lower end outlets of air channel 214 and liquid air interface tube 215. Therefore, no extending tube is needed to connect to the lower end of ink channel 215.

Tube base 22 and fix base 23 are for assembly and attachment to connection base 21 as to provide connection to replenishment cartridge 4. Tube base 22 of the present embodiment is a round tube body. The lower end of tube base 22 includes an outer rim 222 on the outside, and the upper end of tube base 22 includes two opposite inner rims 221. The inner diameter of tube base 22 is equal to or slightly larger than the outer diameter of tube body 211 of connection base 21 so that tube body 211 can be placed inside tube base 22. Fix base 23 is an element for fixing tube base 22 to main cartridge 1. Fix base 23 includes a ring 231, with inner diameter larger than or equal to the outer diameter of tube base 22 and smaller than the outer diameter of outer rim 222. The inner wall of ring 231 includes a trench 2311, and the vertical side wall of tube base 22 includes a protruding column 223. A gap exists between protruding column 223 and outer rim 222, and the thickness of the gap is about the thickness of ring 231. The lower edge of ring 231 includes inner rim trench 232 (shown in FIG. 3B). When tube base 22 is placed outside of tube body 211, fix base 23 is placed from top down. Protruding column 223 passes trench 2311 and finally ring 231 sheathes on the outside of outer rim 222 of tube base 22 so that outer rim 222 is restricted inside inner rim trench 232. In this manner, the position of tube base 22 is restricted, and yet completely fixed. In other words, tube base 22 can rotate within a restricted range. Fix base 23 is fixed to main cartridge 1 by fasteners to form a connection device 2 located main cartridge 1.

The preferred embodiment of replenishment cartridge 4 of the present invention can be any container made of any material capable for storing ink. Replenishment cartridge 4 includes a mouth part 41. The outside of mouth part 41 includes blocks for engaging inner rim 221 of tube base 22. Mouth part 41 further includes a mouth plug 43, fastened by a fix ring 44. To connect replenishment cartridge 4 and main cartridge 1, blocks 42 are passed between tube base 22 and two inner rims 221, and then tube base 22 is rotated so that inner rims 221 shift to above blocks 42 to fasten replenishment cartridge 4.

Figure 3C:
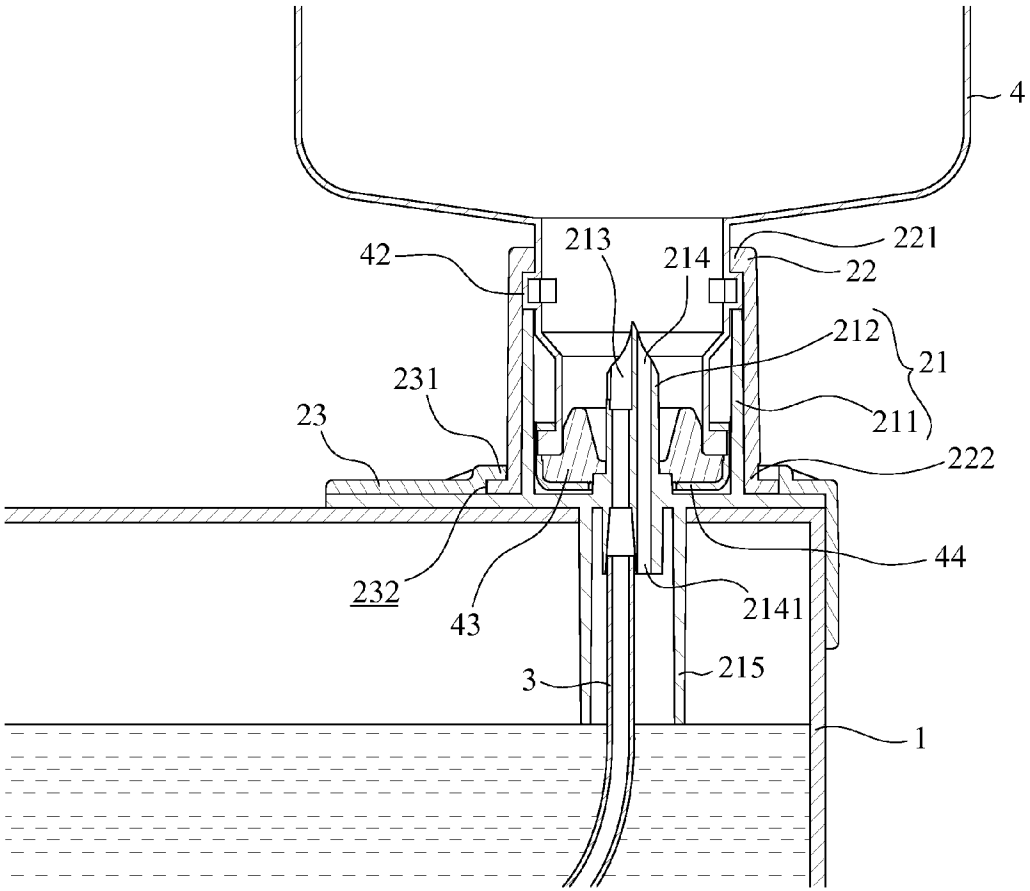
FIG. 3C shows a view of FIG. 3A, with ink level inside cavity of main cartridge contacting and sealing lower end of liquid air interface tube according to the present invention.

FIG. 3B and FIG. 3C show the operation of uninterrupted ink supply system of the present invention. In FIG. 3B, the ink inside the cavity of main cartridge 1 is below the level of the lower end outlet of liquid air interface tube. At this point, replenishment cartridge 4 is connected to connection device 2, the ink inside replenishment cartridge 4 will flow through ink channel 213 and extending tube 3 into the cavity of main cartridge 1, while the air inside the cavity will flow through air channel 214 into replenishment cartridge 4. With the cyclic flow, the ink in replenishment cartridge 4 can flow into main cartridge 1 until the ink level in the cavity of main cartridge 1 rises to contact and seal the lower end outlet of liquid air interface tube 215, as shown in FIG. 3C. At this point, the air inside the cavity of main cartridge 1 can no longer flow through air channel 214 into replenishment cartridge 4, and the cyclic flow stops. Hence, the ink inside replenishment cartridge 4 stops refill main cartridge automatically. In other words, even when the ink inside the cavity of main cartridge is used a little, the lowering of ink level will facilitate replenishment cartridge 4 to refill main cartridge 1 automatically. When the user decides to remove replenishment cartridge 4 for refilling, there still exists inside main cartridge 1 for printing so that the printing will not be interrupted.

Figure 4B:
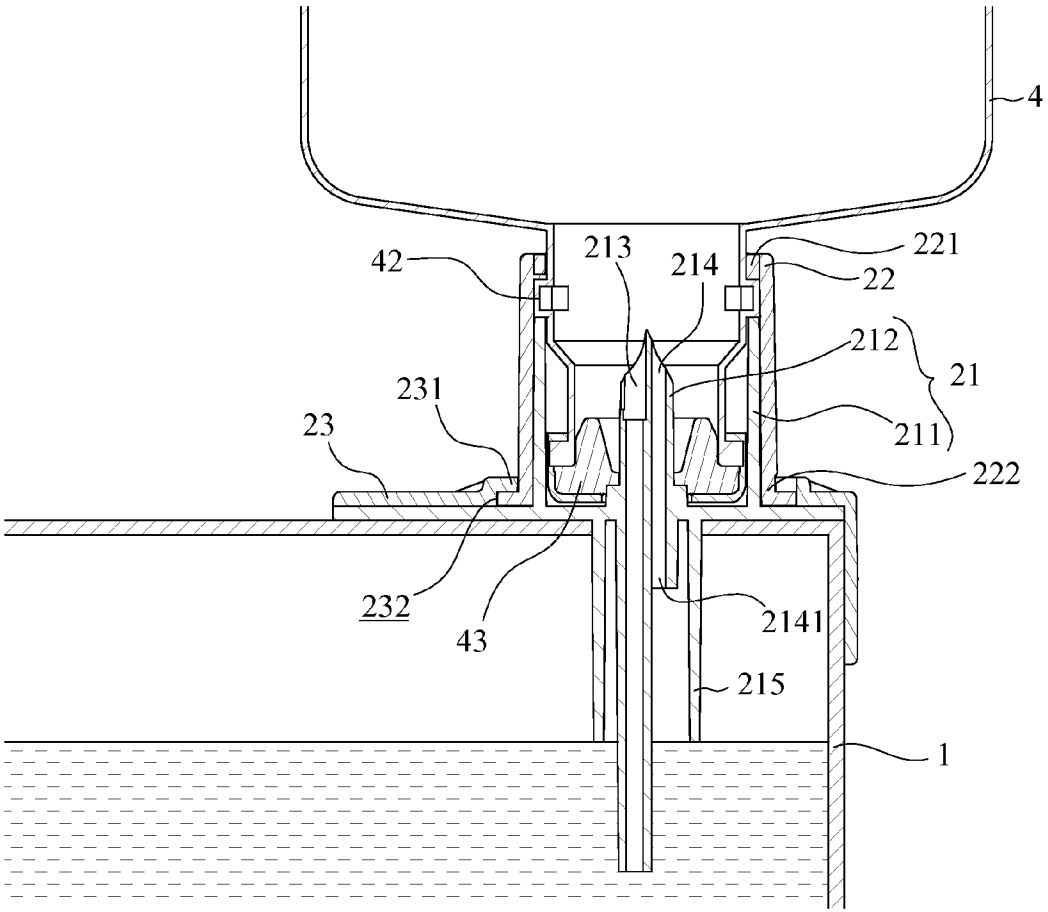
FIG. 4B shows a view of FIG. 4A, with ink level inside cavity of main cartridge contacting and sealing lower end of liquid air interface tube according to the present invention.

FIG. 4A shows the operation of another embodiment of the present invention, where the lower end outlet of ink channel 213 is lower than lower end outlet 2141 of air channel 214 and is not connected to extending tube. Therefore, the ink in replenishment cartridge 4 will flow directly from ink channel 213 into the cavity of main cartridge 1. The air inside the cavity will flow through air channel into replenishment cartridge 4 until the ink level in the cavity of main cartridge 1 rises to contact and seal the lower end outlet of liquid air interface tube 215, as shown in FIG. 4B. At this point, replenishment cartridge 4 will stop refilling ink into main cartridge 1 automatically.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An uninterrupted ink supply system, comprising:

a main cartridge, having a cavity for storing ink;

a connection device, located on said main cartridge, and connecting said cavity inside said main cartridge to outside of said main cartridge, said connection device having a structure for automatic airflow control, and including:

a connection base having a tube body at a top and a liquid air interface tube at a bottom, and being separated by a base plate, the connection base further having a central column extending along an axis inside said tube body and said liquid air interface tube, a lower end of said liquid air interface tube being lower than a lower end of said central column, an internal of said central column having an independent ink channel and an independent air channel, both said ink channel and said air channel flow through said central column, wherein after said connection device is installed to said main cartridge, lower ends of said liquid air interface tube, said ink channel and said air channel are all inside said cavity of the main cartridge; and a replenishment cartridge, connected to said connection device, and using gravity to facilitate ink inside said replenishment cartridge to continuously and automatically flow into said main cartridge, said automatic airflow control structure of said connection device automatically stopping ink flowing from said replenishment cartridge to said main cartridge when an ink level inside said main cartridge reaches a specific height.

2. The uninterrupted ink supply system as claimed in claim 1, wherein an outlet of said lower end of said ink channel is connected to an extending tube.

3. The uninterrupted ink supply system as claimed in claim 1, wherein an outlet of said lower end of said ink channel is lower than said lower end of said air channel.

4. The uninterrupted ink supply system as claimed in claim 1, wherein an upper end of said central column has a needle tip shape.

5. The uninterrupted ink supply system as claimed in claim 1, wherein said connection device further comprises a tube base located outside of said connection base for connecting to said replenishment cartridge.

6. The uninterrupted ink supply system as claimed in claim 5, wherein said tube base has inner rims inside an upper end thereof, and said replenishment cartridge has a mouth part with blocks on an outside thereof for engaging said inner rims.

7. The uninterrupted ink supply system as claimed in claim 6, wherein said mouth part has a mouth plug.

8. The uninterrupted ink supply system as claimed in claim 5, wherein said connection device further comprises a fix base for fastening said connection base and said tube base to said main cartridge.

9. The uninterrupted ink supply system as claimed in claim 8, wherein said fix base has a ring with an inner diameter greater than or equal to an outer diameter of said tube base and smaller than an outer diameter of an outer rim of said tube base, an inner wall of said ring has a trench, and a vertical side wall of said tube base has a protruding column matching said trench so that said ring presses against said protruding column to restrict location of said tube base while allowing said tube base to rotate within a specific range.

* * * * *